US010156087B2

(12) United States Patent
Yu

(10) Patent No.: US 10,156,087 B2
(45) Date of Patent: Dec. 18, 2018

(54) LOCKSET

(71) Applicant: SINOX CO., LTD., New Taipei (TW)

(72) Inventor: Chia-Fang Yu, New Taipei (TW)

(73) Assignee: SINOX CO., LTD., New Taipei (TW)

( * ) Notice: Subject to any disclaimer, the term of this patent is extended or adjusted under 35 U.S.C. 154(b) by 0 days.

(21) Appl. No.: 14/814,189

(22) Filed: Jul. 30, 2015

(65) Prior Publication Data

US 2016/0032620 A1 Feb. 4, 2016

Related U.S. Application Data

(60) Provisional application No. 62/032,320, filed on Aug. 1, 2014.

(51) Int. Cl.

| | |
|---|---|
| ***E05B 65/52*** | (2006.01) |
| ***E05B 37/02*** | (2006.01) |
| ***E05B 37/00*** | (2006.01) |
| ***E05B 65/00*** | (2006.01) |
| ***E05C 3/04*** | (2006.01) |

(52) U.S. Cl.

CPC ..... *E05B 65/52* (2013.01); *E05B 37/0031* (2013.01); *E05B 37/0034* (2013.01); *E05B 37/02* (2013.01); *E05B 65/0092* (2013.01); *E05B 65/5215* (2013.01); *E05C 3/041* (2013.01)

(58) Field of Classification Search

CPC . E05B 5/00; E05B 5/003; E05B 5/006; E05B 37/00; E05B 37/02; E05B 37/0031; E05B 37/0034; E05B 65/0092; E05B 65/48; E05B 65/52; E05B 65/5207; E05B 65/5215; E05B 65/5223; E05B 65/523; E05B 65/5238; E05B 65/5246; E05B 65/5253; E05B 65/5261; E05B 65/5269; E05B 65/5276; E05B 65/8284

See application file for complete search history.

(56) References Cited

U.S. PATENT DOCUMENTS

| | | | | |
|---|---|---|---|---|
| 6,516,641 | B1 * | 2/2003 | Segawa | E05B 13/103 292/DIG. 30 |
| 6,912,880 | B2 * | 7/2005 | Ling | E05B 37/0034 70/284 |
| 7,331,204 | B1 * | 2/2008 | Hsieh | E05B 37/0031 70/69 |
| 7,415,853 | B2 * | 8/2008 | Yu | E05B 37/02 70/21 |
| 7,444,844 | B1 * | 11/2008 | Lee | E05B 37/0034 70/21 |
| 7,628,047 | B2 * | 12/2009 | Lee | E05B 37/0034 70/134 |

(Continued)

*Primary Examiner* — Christopher J Boswell

(74) *Attorney, Agent, or Firm* — Innovation Capital Law Group, LLP; Vic Lin

(57) ABSTRACT

The present invention generally relates to a lockset for use with a luggage including a first body and a second body. The lockset includes a housing embedded in a first side of the first body and a rotatable combination lock disposed in the housing revealing discs. When the rotatable combination lock is locked, the rotatable combination lock could not rotate in the housing and limits the second body not to open from the first body; when the rotatable combination lock is unlocked, the rotatable combination lock could be rotated to an unlock-position in the housing and frees the second body open from the first body.

6 Claims, 8 Drawing Sheets

(56) References Cited

U.S. PATENT DOCUMENTS

| | | | | |
|---|---|---|---|---|
| 7,958,757 | B1 * | 6/2011 | Lee | E05B 37/0034 70/21 |
| 8,113,024 | B2 * | 2/2012 | Yang | E05B 37/0034 70/21 |
| 8,234,891 | B2 * | 8/2012 | Dalton, Jr. | E05B 37/0034 70/21 |
| 8,316,675 | B2 * | 11/2012 | Yang | E05B 37/02 70/21 |
| 8,555,683 | B1 * | 10/2013 | Rieder | E05B 37/0034 70/21 |
| 2011/0142375 | A1 * | 6/2011 | Lebow | E05B 65/52 70/64 |
| 2015/0040622 | A1 * | 2/2015 | Meersschaert | E05B 65/52 70/69 |

* cited by examiner

LOCKSET

RELATED APPLICATION

This application relates to, claims priority from and incorporates by reference herein, as if fully sets forth in the U.S. provisional patent application Ser. No. 62/032,320 filed on Aug. 1, 2014 entitled "Lock."

BACKGROUND OF THE INVENTION

1. Field of the Invention

The present invention generally relates to a lockset for use with a case.

2. Description of the Prior Art

FIG. 1 shows that users usually load items in a case 20 including a lockset 90 while traveling, to secure their luggage. Wherein, the case 20 could be but not limited to a luggage case, a suitcase or a briefcase. Conventionally, the lockset 90 includes a combination lock or a key lock, and users can unlock the lockset 90 to open the case 20 by dialing rotating at least one disc to the right combination or using a matching key. Wherein, the combination lock includes a unlock button 91 to be pressed to unlock the lockset 90 after dialing the rotating discs to the right combination.

Furthermore, the lockset 90 could cooperate with a zipper 40 of the case 20. To secure the zipper 40 with the lockset 90, sliders 41 of the locked zipper 40 can be inserted or embedded into grooves 92 of the lockset 90, and a movable pin or a latch comes through a hole of the sliders 41. To open the case 20, the movable pin or the latch can be released from the hole of the sliders 41 by unlock the lockset 90, and the sliders 41 separated from the grooves 92 of the lockset 90 can be moved to unlock the zipper 40.

However, the lockset 90 protruding from the surface of the case 20 could be broken by impacting or other causes while travelling. Furthermore, the lock mechanism within the lockset 90 and the zipper 40 of the case 20 might be invalid because of the sliders 41 damaged. For another, It might be inconvenience for users to unlock the combination lock by pressing the unlock button 91.

SUMMARY OF THE INVENTION

The present invention generally relates to a lockset for use with a case including a first body and a second body. The lockset includes a housing embedded in a first side face of the first body and a rotatable combination lock disposed in the housing revealing discs. When the rotatable combination lock is locked, the rotatable combination lock could not rotate in the housing and limits the second body not to open from the first body; when the rotatable combination lock is unlocked, the rotatable combination lock could be rotated to an unlock-position in the housing and frees the second body open from the first body.

The housing further reveals a key hole for a matching key inserting to unlock the lockset. The side of the luggage includes a port. The second body includes a tongue extending toward the lockset and into the port. The rotatable combination lock includes a locker, when the rotatable combination lock is locked, the tongue extends into the port and is secured by the locker in the port, to limit the second body not to open from the first body, when the rotatable combination lock rotates to an unlock-position, the locker releases the tongue freed to depart from the port, to open the second body from the first body.

The lockset is disposed across the first body and the second body of the luggage. The housing is embedded in the first body. A part of the housing protrudes from the edge of the first body. A recess is disposed on the second body in a shape corresponding to the protruding part of the housing and contains the part of the housing protruding from the first body. A tongue extending into the housing is disposed on the surface of the recess, when the rotatable combination lock is locked, the tongue is secured by the rotatable combination lock in the housing to limit the second body not to open from the first body, when the rotatable combination lock is unlocked and rotated to an unlock-position, the tongue is freed by the rotatable combination lock to open the second body from the first body.

A lockset for use with a case including a first body and a second body is provided. The lockset includes a housing disposed on a first side face of the first body and a rotatable combination lock disposed in the housing revealing discs. When the rotatable combination lock is locked, the rotatable combination lock could not rotate in the housing and limits the second body not to open from the first body; when the rotatable combination lock is unlocked, the rotatable combination lock could be rotated to an unlock-position in the housing and frees the second body open from the first body.

A lockset for use with a case including a zipper is provided. The lockset includes a mortise disposed on a disk housing by the side of the zipper and opened outside the case. A slider of the zipper includes a tenon inserted to the mortise. When the zipper is locked, the tenon of the slider is inserted to the mortise, the lockset restricts the movement of the tenon. When the tenon of the slider inserts to the mortise, the slider sustainably laminates on the surface of the disk housing.

DETAILED DESCRIPTION OF THE INVENTION

Figure 1:
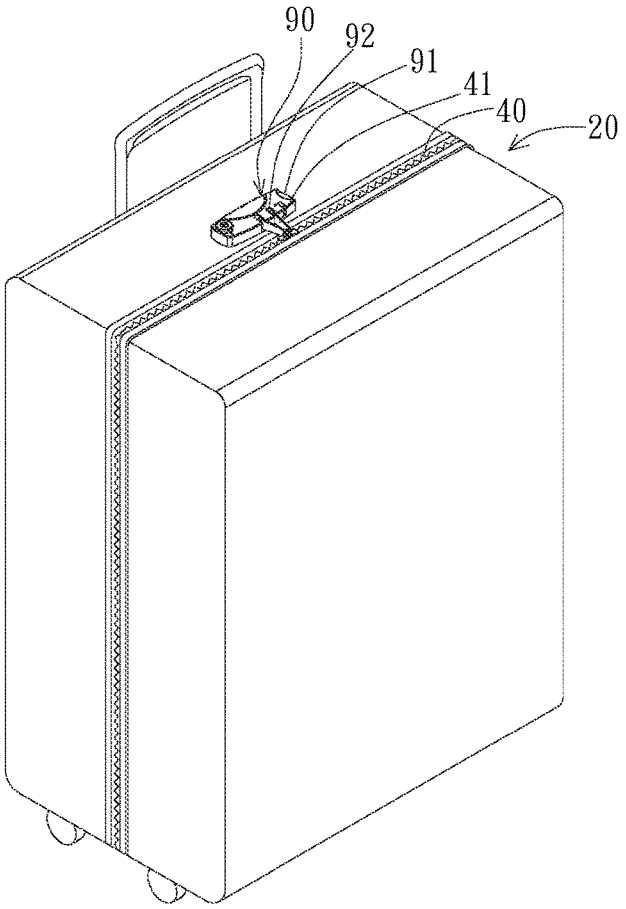
FIG. 1 (PRIOR ART)
FIG. 1 is a perspective view of a prior art.
Figure 2A:
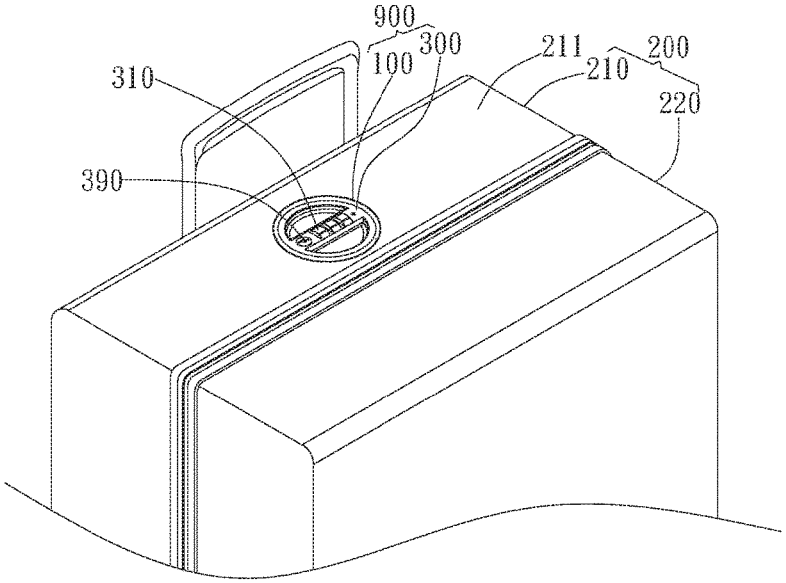
FIG. 2A and FIG. 2B are perspective views of an embodiment of the invention.
Figure 2B:
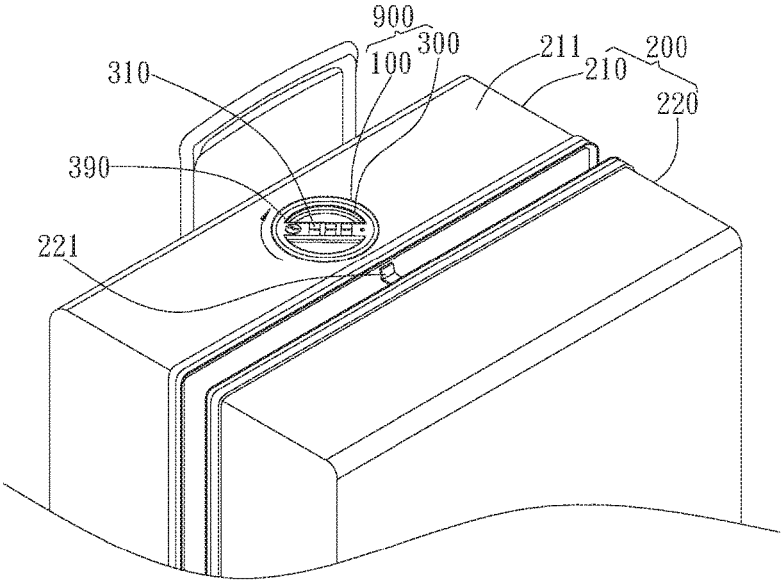

FIG. 2A and FIG. 2B are perspective views of an embodiment of the invention. Referring to FIG. 2A, a lockset 900 for use with a case 200. In this embodiment, the case 200 is a luggage case including a first body 210 and a second body 220. The first body 210 and the second body 220 are connected by an axle side, and the case 200 can be opened from other side among the first body 210 and the second body 220. In other embodiments, the case 200 could be a suitcase or a briefcase and is not limited to a case which is composed by two bodies connecting by a side.

Referring to FIG. 2A, the lockset 900 includes a housing 100 and a rotatable combination lock 300. The housing 100 is embedded in a first side face 211 of the first body 210, and the rotatable combination lock 300 is disposed in the housing 100 revealing discs 310. Wherein, the housing 100 further reveals a key hole 390 for a matching key inserting to unlock the lockset 900. When the rotatable combination lock 300 is locked, the rotatable combination lock 300 could not rotate in the housing 100 and limits the second body 220 not to open from the first body 210. Referring to FIG. 2B, when the rotatable combination lock 300 is unlocked, the rotatable combination lock 300 could be rotated to an unlock-position in the housing 100 and frees the second body 220 open from the first body 210.

Figure 3A:
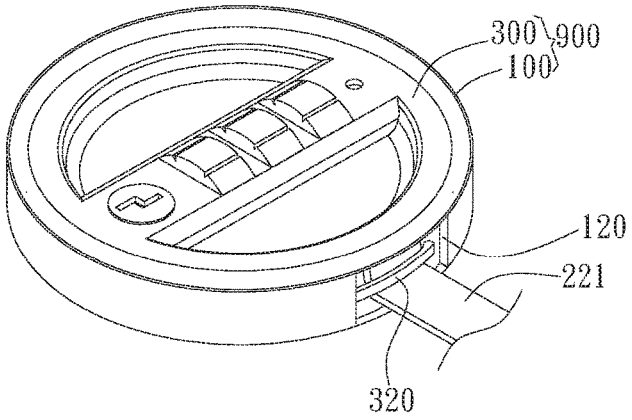
FIG. 3A and FIG. 3B are perspective views to show the movement of a disk housing and a rotatable disk combination lock according to an embodiment of the invention.
Figure 3B:
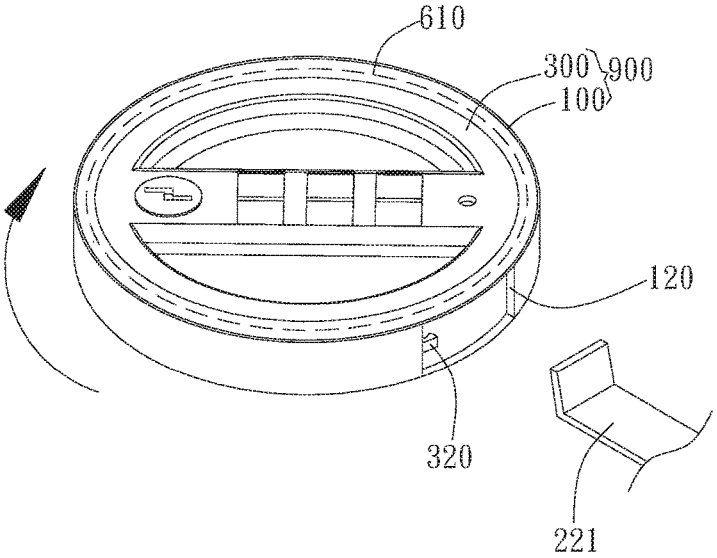

As FIG. 3A and FIG. 3B specifying according to an embodiment of the invention, the side of the luggage 100 comprises a port 120, and the rotatable combination lock 300 comprises a locker 320. The second body 220 includes a tongue 221 toward the lockset 900, and the tongue 221 could extend into the port 120. Referring to FIG. 3A, when the rotatable combination lock 300 is locked, the tongue 221 extends into the port 120 and is secured by the locker 320 in the port 120, to limit the second body 220 not to open from the first body 210. Referring to FIG. 3B, when the rotatable combination lock 300 rotates to an unlock-position 610, the locker 320 releases the tongue 221 freed to depart from the port 120, to open the second body 220 from the first body 210.

Figure 4A:
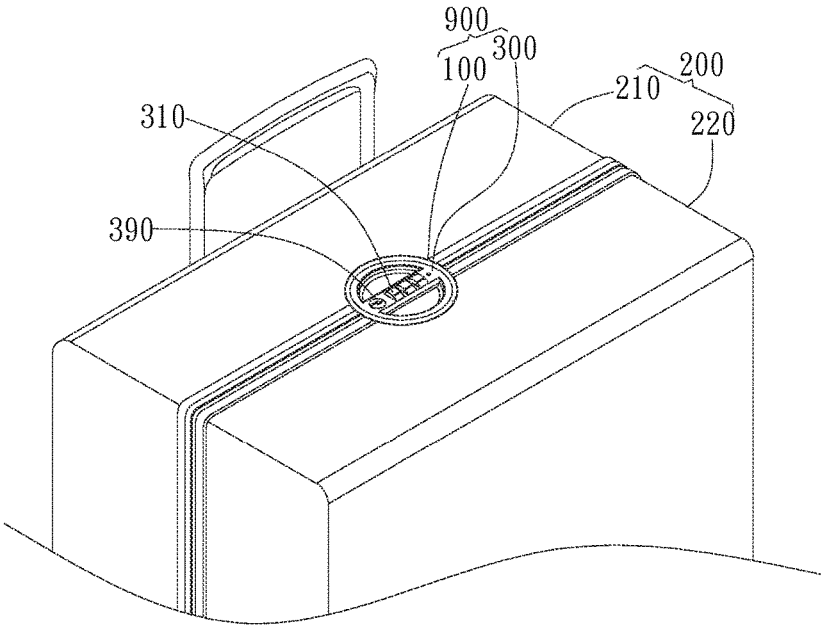
FIG. 4A and FIG. 4B are perspective views to show a lockset disposed across a first body and a second body of a case according to another embodiment of the invention.
Figure 4B:
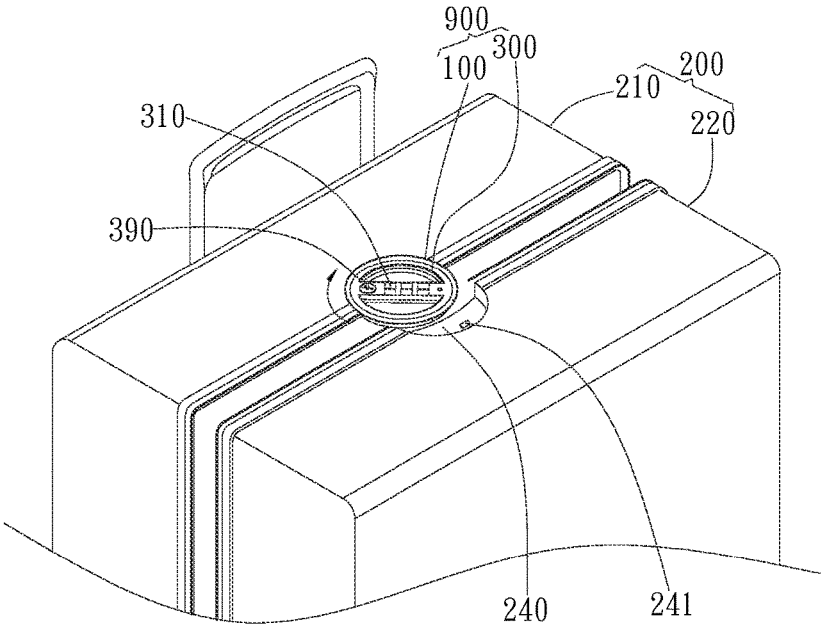

In another embodiment of the invention, the position of a luggage 200 which a lockset 900 is disposed on, could be modified according to demands of design and manufacture. Referring to FIG. 4A and FIG. 4B, a lockset 900 disposed across a first body 210 and a second body 220, of a luggage 200. For more specify, a housing 100 is embedded in the first body 210, and a part of the housing 100 protrudes from the edge of the first body 210. A recess 240 disposed on the second body 220, in a shape corresponding to the protruding part of the housing 100, could contain the part of the housing 100 protruding from the first body 210. A tongue 241 is disposed on the surface of the recess 240, which could extend into the housing 100. When a rotatable combination lock 300 is locked, the tongue 241 is secured by a rotatable combination lock 300 in the housing 100, to limit the second body 220 not to open from the first body 210. Referring to FIG. 4B, when a rotatable combination lock 300 is unlocked and rotated to an unlock-position, the tongue 241 is freed by the rotatable combination lock 300, to open the second body 220 from the first body 210.

In the embodiments shown between FIG. 2A to FIG. 4B, the housing embedded in a surface of the luggage, as an embed lockset design, does not protrude from the surface of the luggage, which prevents any damages by impacting or other causes while travelling. Additionally, the embed lockset design is without zipper, so the lock mechanism of the luggage will not invalid because of the sliders damaged. Furthermore, instead of pressing a unlock button, rotating the lock is more convenient to unlock.

Figure 5:
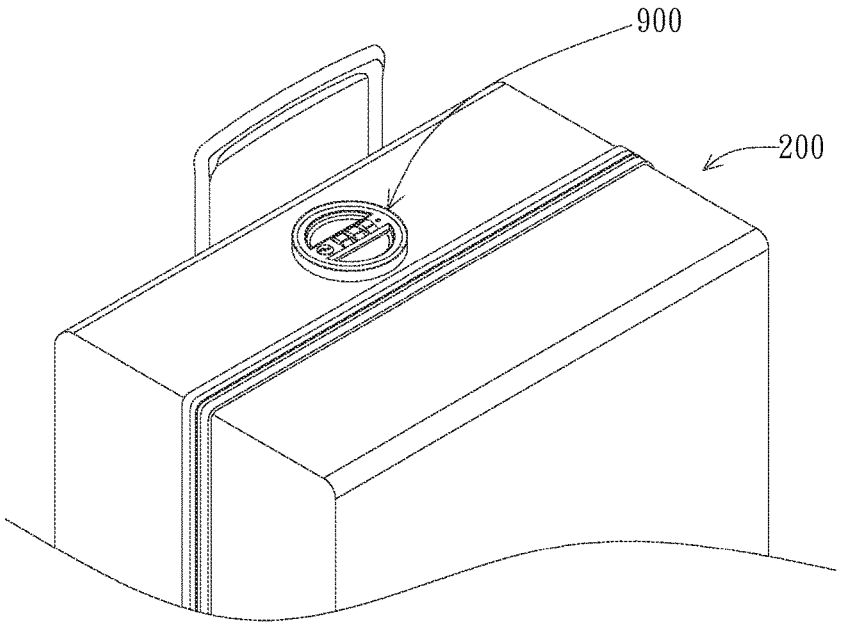
FIG. 5 is a perspective view to show a lockset protrudingly disposed on the surface of a case according to another embodiment of the invention.

However, in other embodiments, considering to the manufacturing costs, sense of design or user preferences, the lockset is not limited to the embed design or to the design without zipper, to keep some of the advantages from the foresaid embodiments. Referring to FIG. 5, a lockset 900 is protrudingly disposed on the surface of a case 200 without a zipper and could be unlock by rotation, which keeps the advantages like not losing lock mechanism because of the damage of the sliders and unlocking without pressing unlock button.

Figure 6A:
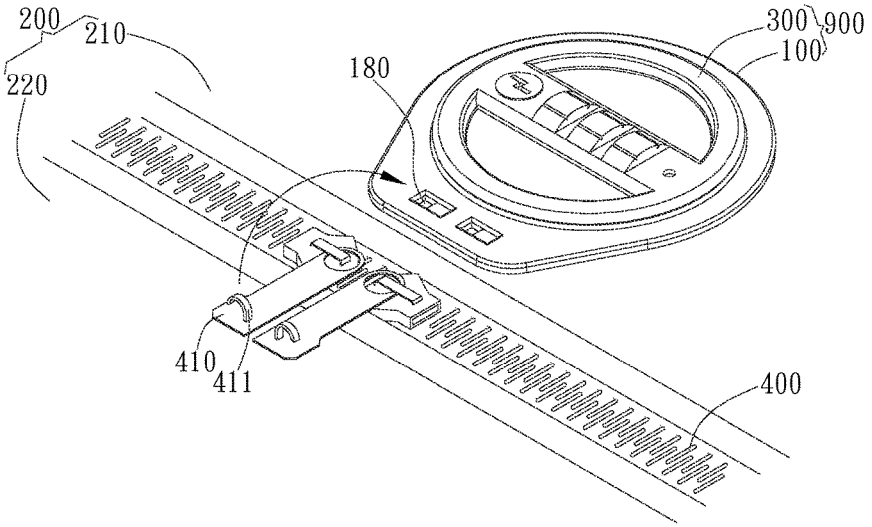
FIG. 6A, FIG. 6B, FIG. 6C and FIG. 6D are perspective views to show a lockset cooperating with a zipper of a case according to another embodiment of the invention.
Figure 6B:
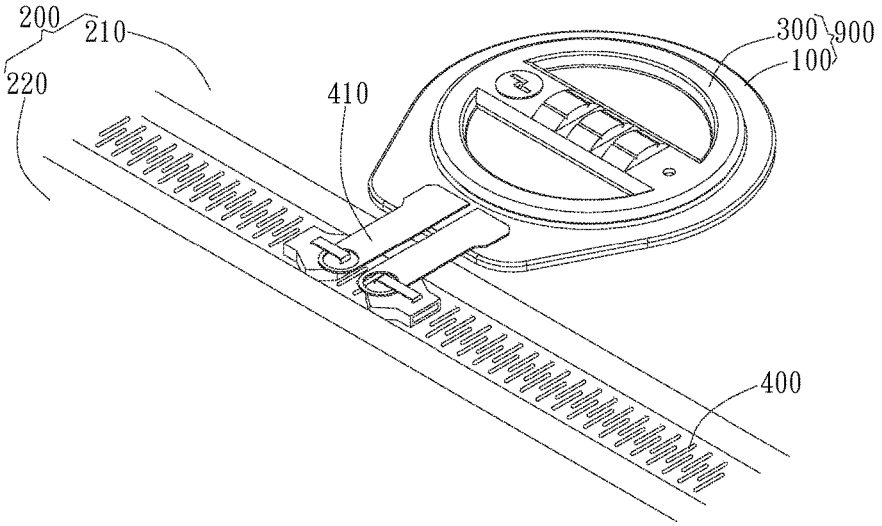
Figure 6C:
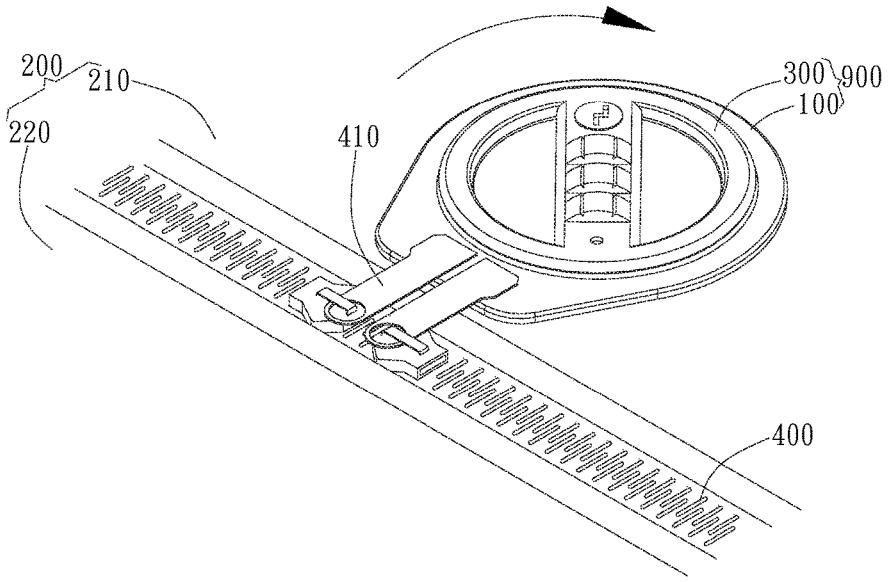
Figure 6D:
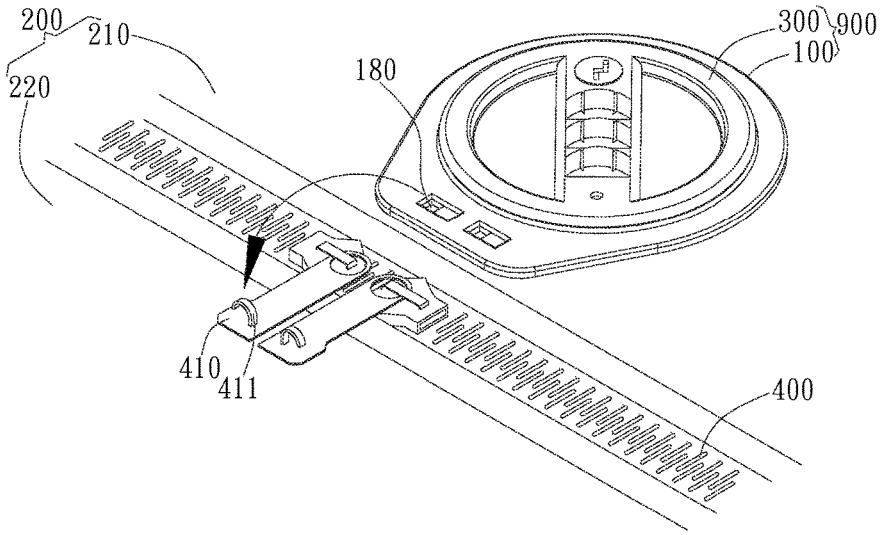
Figure 7:
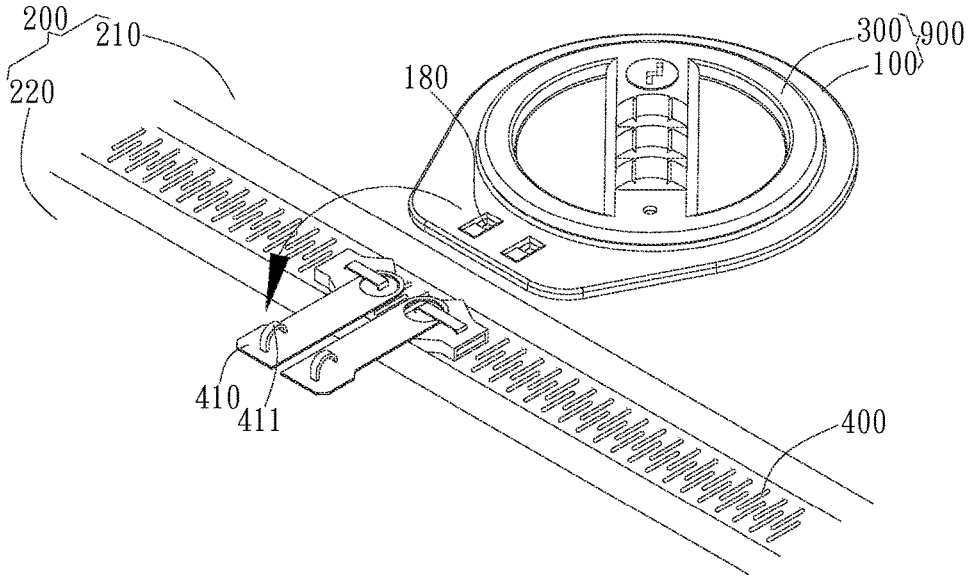
FIG. 7 is perspective view to show a lockset cooperating with a zipper of a case according to another embodiment of the invention.

FIG. 6A, FIG. 6B, FIG. 6C and FIG. 6D are perspective views to show a lockset 900 designed to embed in a luggage 200 and cooperate with a zipper 400 of the luggage 200. Referring to FIG. 6A, the lockset 900 further includes a mortise 180 disposed on a housing 100 by the side of the zipper 400 and opened outside the luggage 200. Wherein, a slider 410 comprises a tenon 411 which could be inserted to the mortise 180. Referring to FIG. 6B, when the zipper 400 is locked, the tenon 411 of the slider 410 could be inserted to the mortise 180, which a hole of the tenon 411 is secured by a movable locker not shown inside the lockset 900 to lock the luggage 200. Referring to FIG. 6C, when user rotates a rotatable combination lock 300 to an unlock-position, the movable locker not shown inside the lockset 900 departs from the hole of the tenon 411 and frees the tenon 411. Consequently, as shown in FIG. 6D, user can remove the tenon 411 from the mortise 180 and unlock the zipper 400 to open a second body 220 from the first body 210 of the luggage 200. Remarkably, in the embodiment shown between FIG. 6A to FIG. 6D, the slider 410 is a laminate design. In more specify, when the tenon 411 of the slider 410 inserts to the mortise 180, the slider 410 sustainably laminates on the surface of the housing 100 to decrease the height of the protrudent part from the surface of the luggage 200 and to avoid situations of damages by impacting or other causes while travelling. In another embodiment shown in FIG. 7, the direction of a tenon 411 and a corresponding mortise 180 could be changed according to demands of design or manufacture.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A lockset for use with a luggage including a first body and a second body, comprising:

a housing embedded in a first side face of the first body; and a rotatable combination lock disposed in the housing revealing discs, wherein neither the housing nor the rotatable combination lock protrude from the first side face, wherein the rotatable combination lock can be rotated in the housing to an unlock-position;

when the rotatable combination lock is locked, the rotatable combination lock could not rotate in the housing and limits the second body not to open from the first body; when the rotatable combination lock is unlocked, the rotatable combination lock could be rotated to the unlock-position in the housing and frees the second body open from the first body.

2. The lockset of claim 1, wherein the housing further reveals a key hole for a matching key inserting to unlock the lockset.

3. The lockset of claim 1, wherein the side of the luggage includes a port, the second body includes a tongue extending toward the lockset and into the port.

4. The lockset of claim 3, wherein the rotatable combination lock includes a locker, when the rotatable combination lock is locked, the tongue extends into the port and is secured by the locker in the port, to limit the second body not to open from the first body, when the rotatable combination lock rotates to an unlock-position, the locker releases the tongue freed to depart from the port, to open the second body from the first body.

5. The lockset of claim 1, wherein the lockset is disposed across the first body and the second body of the case.

6. The lockset of claim 5, wherein the housing is embedded in the first body, and a part of the housing protrudes from the edge of the first body, a recess is disposed on the second body in a shape corresponding to the protruding part of the housing and contains the part of the housing protruding from the first body, a tongue extending into the housing is disposed on the surface of the recess, when the rotatable combination lock is locked, the tongue is secured by the rotatable combination lock in the housing to limit the second body not to open from the first body, when the rotatable combination lock is unlocked and rotated to an unlock-position, the tongue is freed by the rotatable combination lock to open the second body from the first body.

* * * * *